United States Patent [19]

Massit et al.

[11] Patent Number: 4,684,181

[45] Date of Patent: Aug. 4, 1987

[54] MICROCONNECTOR WITH A HIGH DENSITY OF CONTACTS

[75] Inventors: Claude Massit, Grenoble; Gérard Nicolas, Voreppe; Gerard Turc, Echinolles, all of France

[73] Assignee: Commissariat A L'Energie Atomique, Paris, France

[21] Appl. No.: 800,362

[22] Filed: Nov. 21, 1985

Related U.S. Application Data

[63] Continuation of Ser. No. 593,871, Mar. 27, 1984, abandoned.

[30] Foreign Application Priority Data

Mar. 28, 1983 [FR] France ..... 83 05062

[51] Int. Cl.[4] ..... H01R 9/09; H01R 13/629

[52] U.S. Cl. ..... 439/59; 439/630; 439/325

[58] Field of Search ..... 339/17 CF, 74 R, 75 M, 339/75 MP, 147 R, 147 P, 36, 37, 40, 43

[56] References Cited

U.S. PATENT DOCUMENTS

| | | | |
|---|---|---|---|
| 3,399,372 | 8/1969 | Uberbacher | 339/14 R X |
| 3,518,612 | 6/1970 | Dunman et al. | 339/19 |
| 3,805,159 | 4/1974 | Richelmann | 339/74 R X |
| 3,905,670 | 9/1975 | Anhalt et al. | 339/75 MP |
| 4,113,342 | 9/1978 | Andreaggi | 339/176 MP |
| 4,152,037 | 5/1979 | Bonhomme | 339/75 MP |
| 4,386,815 | 6/1983 | Carter et al. | 339/17 M |
| 4,477,133 | 10/1984 | Cosmo | 339/75 MP X |

FOREIGN PATENT DOCUMENTS

| | | |
|---|---|---|
| 1127416 | 10/1962 | Fed. Rep. of Germany . |
| 1440198 | 10/1968 | Fed. Rep. of Germany . |

*Primary Examiner*—Gil Weidenfeld
*Assistant Examiner*—Steven C. Bishop
*Attorney, Agent, or Firm*—Michael N. Meller

[57] ABSTRACT

A microconnector with a high density of contacts which make it possible to connect N parallel electrodes to N electrical conductors. The microconnector comprises a support able to receive the electrodes, N electrically conductive, flexible, elastic wires, respectively connected to the N conductors and fixed to an insulating part movable relative to said support in such a way that the wires are parallel and each of them can come into contact with a single electrode as a result of a displacement of the insulating part when the electrodes are fitted in the support. A cam is provided for moving the part in such a way as to bring about simultaneous contacts between the respective electrodes and wires. The microconnector can be used in connection with flat screen display means.

12 Claims, 8 Drawing Figures

MICROCONNECTOR WITH A HIGH DENSITY OF CONTACTS

This application is a continuation of application Ser. No. 593,871, filed Mar. 27, 1984, and now abandoned.

BACKGROUND OF THE INVENTION

The present invention relates to a microconnector with a high density of contacts. It more specifically applies to the connection between the electrodes of a flat screen, e.g. a liquid crystal display, and an electronic control device, via an electrical circuit. The latter can be obtained in known manner by etching, deposition or screen process printing onto a support, which can either be flexible or rigid.

Connectors are known which make it possible to obtain aligned contacts and which are constituted by a plurality of plugs associated with sockets. When such connectors are used for connecting the electrodes of the aforementioned flat screen, they suffer from the disadvantage of only permitting a low contact density, at the best a few dozen contacts separated from one another by a distance of approximately 1.3 mm.

SUMMARY OF THE INVENTION

The object of the present invention is to obviate this disadvantage.

Thus, the invention relates to a microconnector for connecting N parallel electrodes to a group of N electrical conductors, wherein it comprises a support able to receive the N electrodes, a group of N flexible, elastic, electrically conductive wires, respectively connected to the N electrical conductors and fixed to an electrically insulating part, which is movable relative to the support in such a way that the N wires are parallel and each of them can come into contact with a single electrode in each case as a result of a displacement of the movable part, when the electrodes are installed in said support, and means for moving the part, so as to bring about simultaneous contact respectively between the N electrodes and the N wires.

For example, the electrodes can form a row of parallel electrodes reciprocally arranged in accordance with a given pattern and the wires are then fixed to said movable part so as to form a row of parallel wires reciprocally arranged in accordance with the same pattern. In other words, there are spacings $P_1$, $P_2$ . . . $P_{N-1}$ respectively between the electrodes of rank 1, 2 . . . N and respectively between the corresponding wires of rank 1, 2 . . . N. The spacings $P_1$, $P_2$ . . . $P_{N-1}$ can differ from one another. In an advantageous embodiment, the spacings $P_1$, $P_2$ . . . $P_{N-1}$ are equal and in this case the electrodes are equidistantly arranged according to a given spacing, so that the wires are equidistant in accordance with the same spacing.

Thus, the microconnector according to the invention makes it possible to simultaneously obtain a number N of contacts, approximately 300 to 400 or even higher, by using flexible, elastic metal wires with a diameter of approximately 50 to 200 μm, which are arranged with a spacing of approximately 100 to 700 μm, e.g. approximately 300 μm, which is very advantageous in connection with liquid crystal displays.

Preferably, the wires are made from a copper-beryllium alloy. Such wires are commercially available and can be used in their "as is" condition, except for a possible curvature at one of their ends. This obviates any need for any preshaped, prefabricated, intermediate contact part, the actual wires being used for forming the contacts and improving the latter, as a result of their flexibility and elasticity.

According to a special feature of the microconnector according to the invention, the electrodes are arranged in several parallel, staggered rows on electrically insulating substrates and the wires are also fixed to the part following the same number of parallel, superimposed rows.

According to another special feature, the electrodes are arranged parallel to one another on the same electrically insulating substrate and form a periodic sequence of longitudinally displaced electrodes and the wires are also fixed to the part, so as to form a periodic sequence of parallel, staggered conductors, which are transversely and longitudinally displaced relative to one another.

According to another special feature, the support is hollow and the electrical conductors are other electrodes disposed on an electrically insulating plate carrying at least one electronic microcomponent and located in the hollow support, said other electrodes being connected to the electronic microcomponent.

According to another special feature, the wires are directly connected to the other electrodes.

According to another special feature, the means for moving the part comprise a cam mounted in rotary manner on the support and intended for bearing on the part, so as to obtain the contacts between the electrodes and the wires.

According to another special feature, the microconnector according to the invention also comprises elastic means able to exert a force on said part which tends to move the wires away from the electrodes.

According to another special feature, the part is also displaceable perpendicular to the electrodes, when the latter are installed in said support, so as to be able to regulate the position of the wres with respect to the electrodes.

Finally, according to another special feature, with the part connected to the support by elastic means and the electrodes being arranged on an electrically insulating substrate, the microconnector also comprises an abutment fixed to the part and able to prevent any contact between the wires and the substrate, when said wires are in the connection position and the substrate strikes against the abutment.

BRIEF DESCRIPTION OF THE DRAWINGS

The invention is described in greater detail hereinafter relative to non-limitative embodiments and with reference to the attached drawings, wherein.

DETAILED DESCRIPTION OF THE PREFERRED EMBODIMENTS

Figure 1:
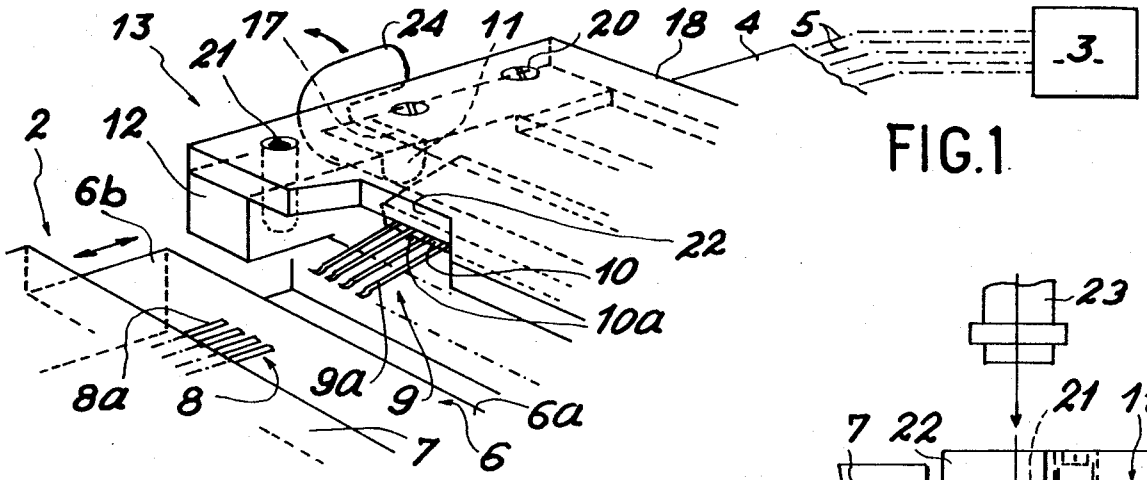
FIG. 1 is a diagrammatic view of a special embodiment of the microconnector according to the invention.

FIG. 1 diagrammatically shows a special embodiment of the microconnector according to the invention and which is used e.g. for connecting a liquid crystal display 2 to an electronic control device 3, via a known flexible circuit 4 which is provided with parallel electrical conductors 5. The liquid crystal display 2 comprises in per se known manner a lower glass plate 6 and an upper glass plate 7 between which are located the liquid crystals. One of the ends 6*a* of the lower glass plate 6 is displaced relative to the upper glass plate 7 so as to project beyond the latter and carries on its upper surface a row of parallel electrodes 8, which are equidistant in accordance with a given spacing. For example, these electrodes are made from indium oxide. For example, there are 300 electrodes arranged with a spacing of 300 μm. Obviously, the number of electrical conductors 5 of the flexible circuit 4 is equal to the number of electrodes 8.

Figure 4:
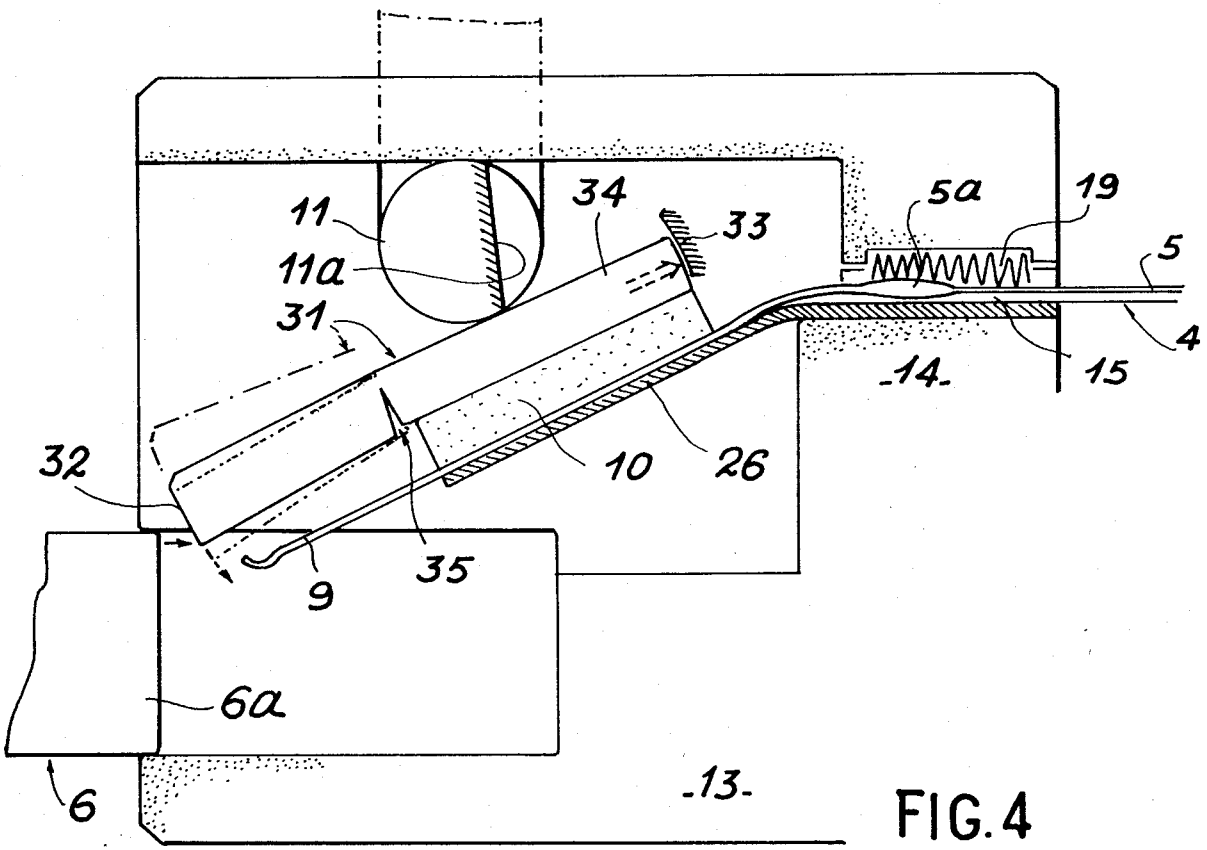
FIG. 4 is a diagrammatic view of a special embodiment of a safety abutment for a microconnector according to the invention.

The microconnector according to the invention essentially comprises a system of flexible, elastic, electrically conductive wires 9, a part 10 which is electrically insulating in order to join them together, and means 11 making it possible to bear on part 10, so as to bring about a contact between the electrodes 8 of display 2 and the flexible, elastic wires 9. For example, the latter are commercially available bare wires, made from a copper-beryllium alloy and whose diameter is e.g. approximately 125 μm. The number of wires 9 is equal to the number of electrodes 8 and said wires 9 are respectively welded to the electrical conductors 5 of flexible circuit 4, e.g. with Sn/Pb remelting. FIG. 4 shows a weld 5*a* between one of the wires 9 and the associated conductor 5.

Part 10 serves to rigidly interconnect the wires 9, in such a way that they form a row of conductors of the same length (e.g. approximately 4 mm), which are parallel and equidistant with respect to one another and which have the same spacing as exists between adjacent electrodes 8. For example, part 10 is constituted by a plastic strip, provided with transverse grooves 10*a*, which are equidistant from one another in accordance with the aforementioned spacing and in which are respectively secured the wires 9, e.g. by adhesion or bonding. Part 10 can also be produced by directly molding a plastic material around wires 9, without it then being necessary to produce the transverse grooves.

Thus, strip 10 and wires 9 form a type of comb, whose teeth are constituted by the wires 9. Edges 6*b* of end 6*a* of lower plate 6, which flank the row of electrodes 8, are respectively slidably inserted between bottom wall 52 and the proximal ends of two side walls 12 of a hollow support or box 13, said two walls facing wall 52 and forming rectilinear recesses 50 therebetween. In FIG. 1 only one of the walls 12 is shown.

The electrical conductors 5 are obviously electrically insulated from one another and are juxtaposed in the flexible circuit 4, which can therefore be flat. Moreover, the flexible circuit 4 has in per se known manner an electrically insulating face 4*a*. It can be seen in FIG. 2 that support 13 has a back wall 14, which is located between the two side walls 12. The end 15 of flexible circuit 4, from which wires 9 extend, is placed on back wall 14, in such a way that the electrically insulating face 4*a* of flexible circuit 4 rests against back wall 14 and strip 10 is located in the space 16 formed within hollow support 13 and defined by the two side walls 12 and back wall 14. The strip 10 is parallel to the row of electrodes 8. The space between the two side walls 12 is obviously adapted to the size of strip 10. Each wire 9 then faces an electrode 8, without any contact therewith.

The means 11 for bearing on strip 10 are formed by a cam in the form of a cylindrical bar which has in per se known manner a flat surface 11*a* and its ends seated in two bearings 17, whereof only one is shown in FIG. 1 and which are respectively made facing one another in the side walls 12 of support 13, so that the axis of cam 11 is parallel to the row of electrodes 8. When the lower plate 6 is slidably inserted in support 13 and when the flat surface of cam 11 is in contact with strip 10, the manipulation of the cam makes it possible to lower said strip 10, each wire 9 then coming into contact with the electrode 8 which is associated therewith and which faces it. Moreover, support 13 is closed by a cover 18 which bears, via a part 19 made from rubber or some other electrical insulation, on end 15 of flexible circuit 4, at welds 5*a* (FIG. 4).

Screws 20 make it possible to fix cover 18 to walls 12 of support 13. Other screws 21 pass through cover 18 and are respectively screwed in walls 12 of support 13 and pass through these walls so as to bear against end 6*a* of the lower plate 6, which is displaced relative to the upper plate 7, in order to maintain the lower plate 6 in position in support 13. These other screws 21 are advantageously made from a plastic material, such as that known under the trade name Teflon, so as not to damage the lower glass plate 6. Finally, the edge of cover 18, positioned above wires 9, has a recess 22 making it possible to observe at least one of the two ends of the row of wires 9.

Figure 2:
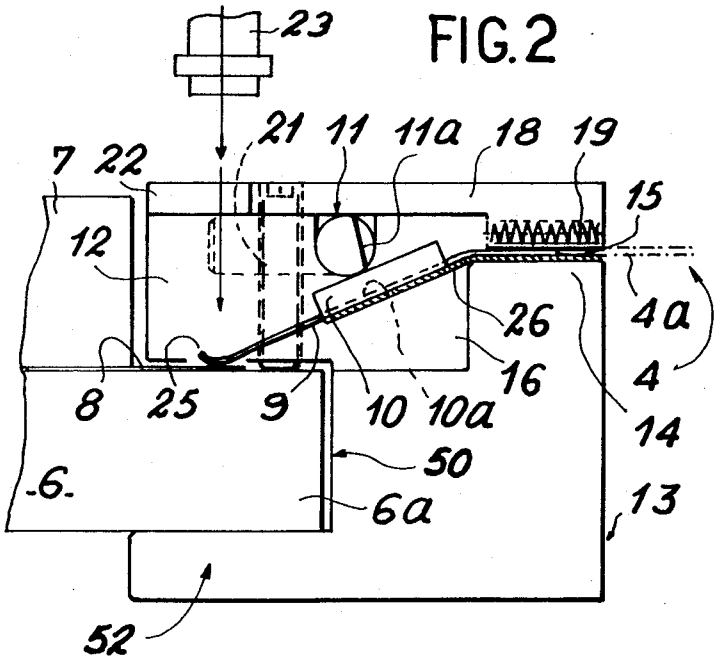
FIG. 2 is a diagrammatic sectional view of the microconnector of FIG. 1.

The fitting of the microconnector according to the invention then takes place in the following way (FIG. 2). The lower plate 6 of the liquid crystal display is slidably inserted in support 13. The insulating face 4*a* of end 15 of flexible circuit 4, said end being extended by the wires 9 which are interconnected by strip 10, is placed on back wall 14 of support 13, in such a way that strip 10 receives from above the cam 11 and each wire 9 is positioned above the electrode 8 associated therewith. Cover 18 is fitted and screwed onto support 13 by means of screws 20. The cam 11 is manipulated in such a way that it bears against strip 10 and consequently the latter is lowered. Binoculars 23 are then used to observe the first wire 9*a* (FIG. 1) of the row of wires 9 through recess 22 and slight movement of flexible circuit 4 and/or the system of plates 6 and 7 until perfect alignment is brought about between the first wire 9*a* and the first electrode 8*a* of the row of electrodes 8, which guarantees the alignment of each of the wires 9 with one of the electrodes 8, after which screws 21 are tightened.

In order to close the microconnector according to the invention as shown in FIG. 1, i.e. to establish contacts between electrodes 8 and wires 9 (and therefore conductors 5), it is merely necessary to manipulate cam 11 in an appropriate direction, in such a way that the cam bears against strip 10 and the latter is lowered in order to bring about the necessary contacts between electrodes 8 and wires 9. The opening of the microconnector according to the invention (i.e. the opening of said contacts) takes place by manipulating the cam in the other direction, which releases strip 10 and enables wires 9 to rise again as a result of their elasticity. Obviously, strip 10 is chosen in such a way as to have sufficiently low weight not to bend wires 9 when cam 11 is not bearing on said strip 10.

Cam 11 is manipulated by means of handles 24 located at each of its ends. In order to carry out this manipulation, it is also possible to provide the ends of cam 11 with hexagonal slots, into which is introduced a hexagon wrench. In order to prevent damage to electrodes 8, the ends 25 of wires 9, which are intended to come into contact with said electrodes 8, can be curved upwards. Moreover, the wires 9 can undergo a surface treatment, such as gold plating of the ends which are to come into contact with the electrodes, for the purpose of reducing contact resistance.

It is also possible to provide the microconnector according to the invention with elastic means 26 able to exert a force on strip 10 which tends to urge the wires 9 away from elctrodes 8 upon manipulating cam 11 in order to break contact between wires 9 and electrodes 8. The elastic means 26 are e.g. constituted by a slightly curved flat spring, e.g. made from a copper-beryllium alloy. The convex portion of spring 26 is turned towards cover 18. One of the ends of said spring is fixed to the top surface of back wall 14 of support 13 below the flexible circuit 4, the insulating face 4*a* thereof resting against spring 26. The other end of spring 26 is fixed beneath strip 10.

Figure 3:
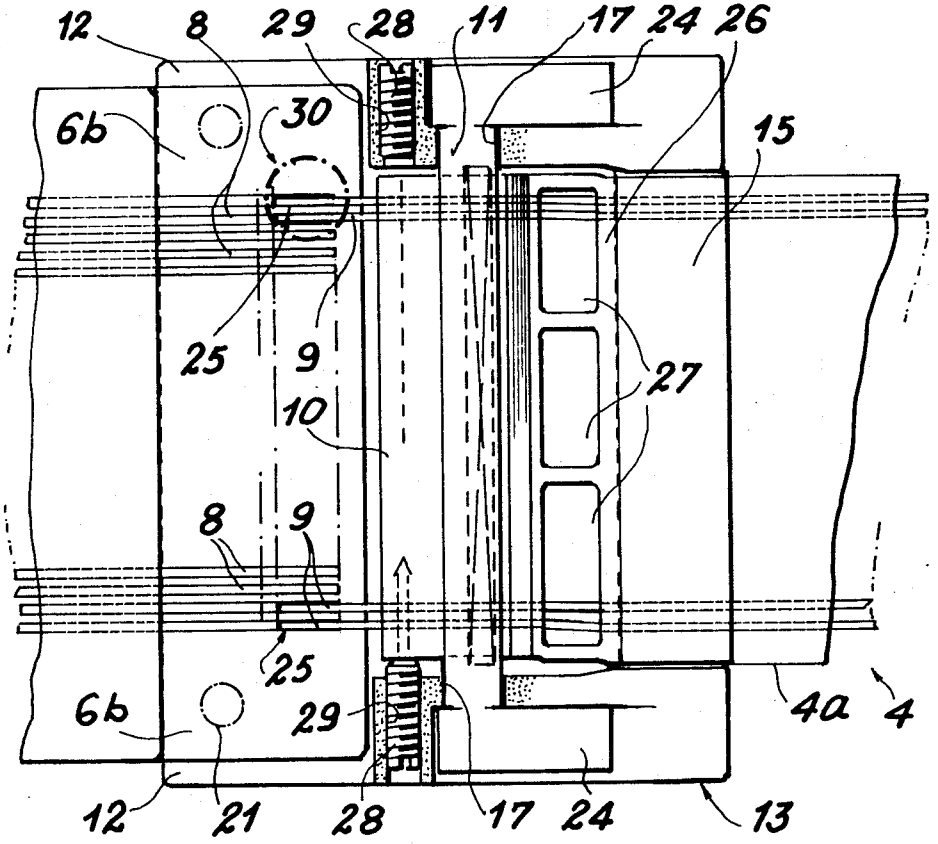
FIG. 3 is a diagrammatic view of another special embodiment of the microconnector according to the invention.

FIG. 3 diagrammatically shows another special embodiment of the microconnector according to the invention. It is identical to that described hereinbefore, with the exception of the characteristics of strip 10 and spring 26. In this embodiment, shown without its cover 18, strip 10 and spring 26 are connected so as to form a single part, which can be made e.g. by molding a plastic material, whilst spring 26 is provided with recesses 27 aligned parallel to strip 10. Recesses 27 make it possible for spring 26 to deform slightly in a direction parallel to the row of electrodes 8, i.e. perpendicular to said electrodes. Thus, strip 10 is able to move slightly in a direction parallel to said row of electrodes 8. This movement is controlled by two screws 28, which respectively abut against the two ends of strip 10 and which are movable in two threaded holes 29 made in walls 12 of support 13, parallel to the axis of cam 11. It is then possible to fit the microconnector shown in FIG. 3, by locking screws 20, 21 (FIG. 1), after ensuring the best possible positioning of each wire 9 relative to the corresponding electrode 8. The final setting of the position of wires 9 relative to electrodes 8 takes place by turning screws 28 (i.e. by screwing in one and unscrewing the other or vice versa for the number of times which this is necessary) until a perfect alignment is obtained between electrodes 8 and wires 9. The setting is checked by means of binoculars 23 (FIG. 2), making it possible to observe the screwing area 30 constituted by one of the ends of the row of wires 9.

FIG. 4 diagrammatically shows a special embodiment of a safety abutment 31, which makes it possible to prevent deterioration of wires 9 when the latter are in the connection position (cam 11 then bearing against strip 10) and the end 6*a* of the lower plate 6 (not positioned in support 13) is inserted in the latter. Abutment 31 is, for example, constituted by a plastic material plate fixed to strip 10, so as to be positioned between the latter and cam 11 and whereof one end projects beyond strip 10 so as to cover wires 9. The plastic material from which plate 31 is made is transparent, so that it is possible to observe wires 9 through said plate 31. Moreover, strip 10 is associated with spring 26 (FIG. 2 or 3).

The end 32 of plate 31 covering wires 9 is bevelled in such a way that the plate 31 is lowered when the end 6*a* of lower plate 6 abuts against said ends 32 of plate 31. An auxiliary abutment 33 is fitted in support 13, so as to be positioned in the vicinity of the other end 34 of plate 31, said other end 34 being slightly convex and the abutment 33 adapting the shape of said end. When the system of plates 6 and 7 is not in position in support 13, wires 9 being in the connection position, cam 11 then bearing against plate 31, and end 6*a* of lower plate 6 striking against the bevelled end of plate 31, the latter is lowered and is held at its other end 34 by auxiliary abutment 33, so that wires 9 are protected from any damage. The bottom of plate 31 can also be provided with a V-shaped slit 35 in the vicinity of the bevelled end 32, said slit being substantially perpendicular to wires 9. When end 6*a* of lower plate 6 strikes against plate 31, the latter can then bend as a result of the slot 35, which aids its lowering.

Figure 5:
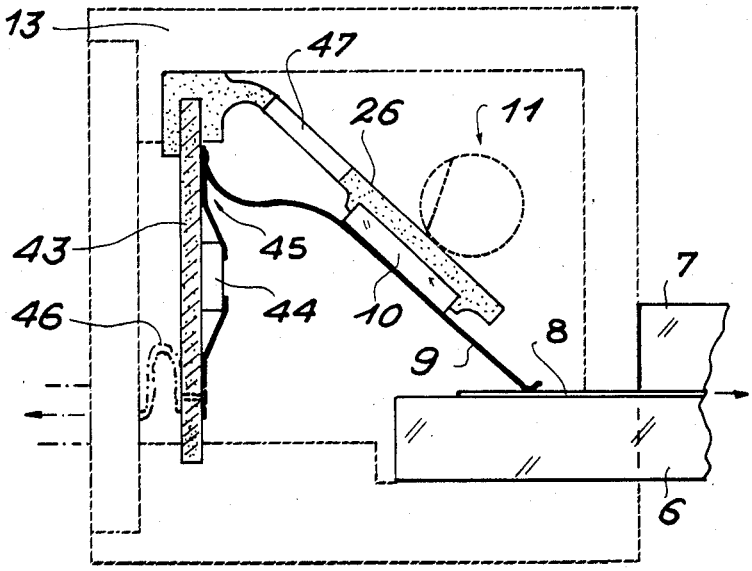
FIGS. 5 and 6 are diagrammatic view of microconnectors according to the invention, incorporating a hollow support, which is able to house the electronic microcomponents for connection to electrodes by the microconnectors in question.

FIG. 5 diagrammatically shows another special embodiment of the microconnector according to the invention. Once again, it comprises the hollow support or box 13, which houses the flat spring 26, whereof one end is fixed to the upper portion of support 13 and whereof the other end carries the strip 10. Cam 11 can bear against spring 26 in such a way that the wires 9, carried by strip 10, come into contact with electrodes 8 located on the glass plate 6. Wires 9 make it possible to connect electrodes 8 to the main part of the electronic control device which is formed by a plurality of electronic microcomponents 44, such as integrated circuits, fitted onto an electrically insulating plate 43. The latter carries a row of other parallel electrodes 45, to which are appropriately connected the microcomponents 44.

Plate 43 is vertically fixed in the hollow support 13, level with the end of spring 26, which is fixed to the upper portion of support 13, in such a way that said other electrodes 45 are then located at the top of the thus positioned plate. The free ends of wires 9, i.e. those which are not intended to come into contact with the electrodes 8, are respectively welded to the other electrodes 45. Spring 26 has an opening 47 through which it is possible to reach the other electrodes 45 and make the various welds. FIG. 5 also shows the wires 46 for connecting the microcomponents 44 to earth and to the remainder of the electronic control device (power supply, timing mechanisms, etc., which are not shown).

In view of the elasticity of wires 9, spring 26 is not necessary and the cam then acts directly on strip 10.

Figure 6:
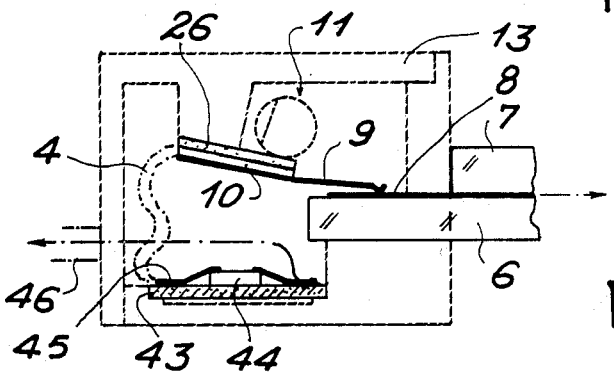

FIG. 6 diagrammatically shows a microconnector like that described hereinbefore with reference to FIG. 5. The only difference between the embodiments of FIGS. 5 and 6 is in the position of plate 43, which is fixed horizontally to the bottom of hollow support 13, and the other electrodes 45 which are connected to wires 9 by a flexible electrical circuit 4.

Figure 7:
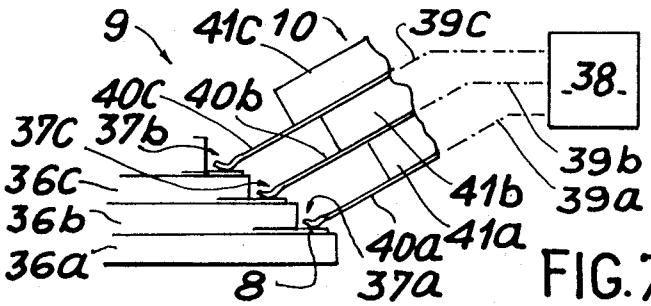
FIGS. 7 and 8 are diagrammatic views of other special embodiments of the microconnector according to the invention.

FIG. 7 diagrammatically shows another special embodiment of the microconnector according to the invention. It makes it possible to simultaneously make several series of connections at different levels. This embodiment more particularly makes it possible to make connections between a plurality of rows of electrodes, e.g. three rows 37*a*, 37*b*, 37*c*, respectively disposed on the glass plates 36*a*, 36*b*, 36*c*, which are reciprocally displaced in such a way as to form a series of steps, and an electronic control device 38, via electrical conductors carried by the flexible circuits 39*a*, 39*b*, 39*c* which can also be connected so as to form a single circuit. For this purpose, the microconnector shown in FIG. 7 has three superimposed rows 40*a*, 40*b*, 40*c* of metal wires 9, similar to the row of wires 9 shown in FIG. 1, which are intended to come into contact respectively with the rows of electrodes 37*a*, 37*b*, 37*c*. The rows of metal wires 40*a*, 40*b*, 40*c* are obviously respectively connected to the series of conductors of circuits 39*a*, 39*b*, 39*c*. They are fixed to an insulating part 10, formed here by superimposed insulating strips 41*a*, 41*b*, 41*c*, each row of wires being respectively fixed to a strip. A (not shown) cam is provided so as to bear on the upper strip 41*c*, which brings about the desired contacts between the metal wires and the electrodes. Obviously, the microconnector according to the invention and shown in FIG. 7 has a support (not shown), into which can be fitted plates 36*a*, 36*b*, 36*c* and in which the cam can rotate, as explained relative to FIG. 1. The circuits 39*a*, 39*b*, 39*c* are secured between an edge (not shown) of said support and the cover of the latter (not shown).

Figure 8:
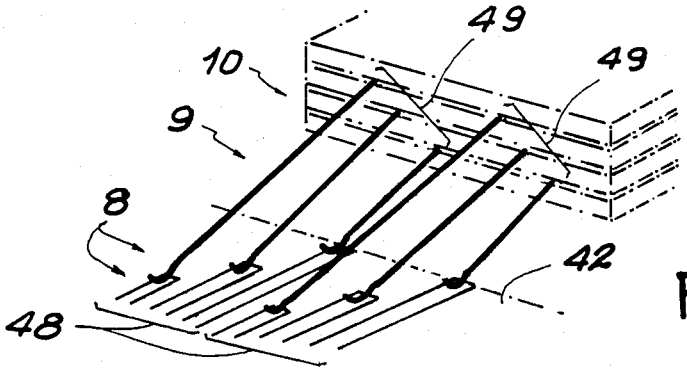

FIG. 8 diagrammatically shows another special embodiment of the microconnector according to the invention for electrodes 8 which are arranged parallel to one another on the same glass plate 42 (identical to plate 6 in FIG. 1) and which form a periodic sequence of electrodes which are longitudinally displaced relative to one another. Thus, there is a row of electrodes 8, formed from a succession of identical patterns 48. Each pattern 48 has a number N of electrodes, each of these electrodes extending further than the preceding electrodes. The wires 9 are then fixed to the insulating part 10, so as to form a periodic sequence of parallel, staggered wires, which are transversely and longitudinally displaced from one another. More specifically, there is a succession of identical wire patterns 49, each pattern 49 having a number N of wires, each wire 9 extending further than the preceding wire and being displaced relative thereto not only in length, but also laterally, so that on lowering part 10, each wire 9 comes into contact with a single electrode 8.

Thus, the microconnector according to the invention makes it possible to simultaneously obtain several hundred electric contacts. Moreover, the obtaining or elimination of connections between the wires and the electrodes is very fast. Finally, the force necessary for bringing about said connections is virtually zero, because the microconnector according to the invention requires no insertion of plugs into sockets. Moreover, the aforementioned description shows that the microconnector according to the invention can serve as a fast make-and-break switch.

What is claimed is:

1. A microconnector for connecting N parallel electrodes to a plurality of N electrical conductors, comprising a support on which said conductors are fixedly mounted, said support being able to receive the N electrodes, a plurality of N parallel, flexible, elastic, electrically conductive wires respectively fixedly connected to the N electrical conductors and fixed to an electrically insulating part which is movable relative to the support such that when the electrodes are installed in said support, the wires and the electrodes are not in contact when the insulating part is in a first position, and the wires and electrodes are in contact when the insulating part is in a second position, and means for moving the insulating part from the first position to the second position without displacing said support relative to said electrodes, so as to bring about simultaneous contact between the N electrodes and the respective N wires, said moving means being mounted on and movable relative to said support.

2. A microconnector according to claim 1, wherein the electrodes are arranged in several parallel, staggered rows on electrically insulating substrates, and the wires are also fixed to the part insulating following the same number of parallel, superimposed rows.

3. A microconnector according to claim 1, wherein the electrodes are arranged parallel to one another on the same electrically insulating substrate and form a periodic sequence of longitudinally displaced electrodes and the wires are also fixed to the insulating part, so as to form a periodic sequence of, staggered rows of parallel conductors which are transversely and longitudinally displaced relative to one another.

4. A microconnector according to claim 1, wherein the support is hollow and the electrical conductors are other electrodes disposed on an electrically insulating plate carrying at least one electronic microcomponent and located in the hollow support, said other electrodes being connected to the electronic microcomponent.

5. A microconnector according to claim 4, wherein the wires are directly connected to said other electrodes.

6. A microconnector according to claim 1, wherein the means for moving the insulating part comprises a cam mounted in rotary manner on the support and intended for bearing on said part, so as to be able to bring about contact between the electrodes and the wires.

7. A microconnector according to claim 1, further comprising resilient means able to exert a force on said insulating part for moving the wires away from the electrodes.

8. A microconnector according to claim 1, wherein the insulating part is also displaceable perpendicular to the electrodes when the latter are fitted in the support, so as to be able to regulate the position of the wires relative to the electrodes.

9. A microconnector according to claim 1, wherein the insulating part is connected to the support by resilient means, the electrodes are arranged on an electrically insulating substrate, and the microconnector further comprises an abutment fixed to the insulating part and able to prevent any contact between the wires and the substrate when said wires are in the connection position and the substrate strikes against the abutment.

10. A microconnector according to claim 1, wherein the electrodes are arranged on an insulating substrate and wherein the support comprises a cover, said cover being provided with means for fixing said substrate relative to the support and with a recess making it possible to observe at least the first or last of the plurality of wires.

11. A microconnector according to claim 1, wherein said wires are made from a copper-beryllium alloy.

12. A microconnector according to claim 1, wherein each of said wires has a substantially straight portion, said wires being arranged such that said substantially straight portions are substantially parallel and rotate relative to a fixed point when said moving means moves said insulating part from the first position to the second position.

* * * * *